US007766189B2

(12) United States Patent
Shaw et al.

(10) Patent No.: US 7,766,189 B2
(45) Date of Patent: Aug. 3, 2010

(54) UNIVERSAL HUB FOR A FLUID DISPENSER

(75) Inventors: Robert K. Shaw, Lindenhurst, IL (US); Mario E. Semchuck, Scottsdale, AZ (US); Don C. Arnold, Gurnee, IL (US)

(73) Assignee: Technical Concepts, LLC, Mundelien, IL (US)

( * ) Notice: Subject to any disclaimer, the term of this patent is extended or adjusted under 35 U.S.C. 154(b) by 606 days.

(21) Appl. No.: 11/674,952

(22) Filed: Feb. 14, 2007

(65) Prior Publication Data

US 2007/0187427 A1 Aug. 16, 2007

Related U.S. Application Data

(60) Provisional application No. 60/773,503, filed on Feb. 14, 2006.

(51) Int. Cl.
*B67D 1/00* (2006.01)

(52) U.S. Cl. ..... 222/52; 4/678

(58) Field of Classification Search ..... 222/52, 222/173, 180, 333; 251/129.04; 137/801; 4/675–678

See application file for complete search history.

(56) References Cited

U.S. PATENT DOCUMENTS 3,902,600 A 9/1975 Turner et al.
4,886,207 A * 12/1989 Lee et al. ..... 236/12.12
5,165,121 A * 11/1992 McTargett et al. ..... 4/678
5,224,509 A * 7/1993 Tanaka et al. ..... 137/315.03
6,082,407 A * 7/2000 Paterson et al. ..... 137/801
6,256,810 B1 * 7/2001 Baker ..... 4/678
7,162,755 B2 * 1/2007 Mintz et al. ..... 4/695
7,207,075 B2 * 4/2007 Peterson et al. ..... 4/678
2003/0155371 A1 8/2003 Collasius et al.

OTHER PUBLICATIONS

International Searching Authority, International Preliminary Report on Patentability, Aug. 28, 2008.

* cited by examiner

*Primary Examiner*—Lien T Ngo
(74) *Attorney, Agent, or Firm*—Dennis J. Williamson; Moore & Van Allen, PLLC

(57) ABSTRACT

A removable and replaceable dispensing head for a fluid dispenser system adapted to deliver the fluid to a user includes a hollow shank extending on an axis. A shank hub is attached to the hollow shank, and an aperture aligned with the hollow portion of the shank extends through the shank hub. A first fixed body is removably attached to the shank hub, the first fixed body and shank hub each having corresponding first attachment means arrayed in a predetermined pattern. A fluid conveyance path is provided through the hollow shank, first fixed body and shank hub. A second fixed body is provided having a second attachment means arrayed in the same predetermined pattern, the second attachment means corresponding to the first attachment means in the shank hub enabling removable attachment of the second fixed body to the shank hub upon removal of the first fixed body from the shank hub. A sensor attached to either the fixed body, or to a hub spacer connected to the shank hub, automatically detects the presence of a user and activates the fluid dispensing system.

14 Claims, 5 Drawing Sheets

UNIVERSAL HUB FOR A FLUID DISPENSER

This patent claims the benefit of a prior filed provisional application No. 60/773,503 filed Feb. 14, 2006, to the extent allowed by law.

The present invention relates generally to fluid dispensing devices, and more particularly to an automatic fluid dispensing apparatus providing a universal hub and sensor assembly that accommodates a wide variety of styles and designs of fluid dispensing heads.

BACKGROUND OF THE INVENTION

Modern washroom facilities, such as those found in commercial, industrial and residential facilities, provide automatically actuated flushing devices, fragrance dispensers, water controls, drying devices, door operators and hand soap dispensing devices. The purpose is to provide a sanitary and substantially germ free and odor free environment that eliminates the necessity of the user of the washroom facility touching any of the permanent fixtures of the washroom. In this regard, automatic liquid dispensers have been developed to automatically dispense a liquid soap solution into the hands of a user without requiring the user to touch the liquid dispenser structure. Examples of such devices are shown in U.S. Pat. Nos. 6,467,651 and 6,651,851.

In presently marketed liquid dispenser devices, such as liquid soap dispensers and other liquid and fluid dispensers, a hub assembly extends upward from the countertop surface in which a sink and a water supply faucet are installed. A partially rotatable spout, or a non-rotatable spout, is attached to the hub assembly to convey liquid through the hub and spout, and to the user.

When an automatic fluid dispenser such as presently marketed is installed, the hub assembly connecting the spout to a pump and fluid source must specifically match the attachment configuration of the dispensing head or spout. Thus, when a new dispensing head of a different style or manufacturer, or of an updated model of the same manufacturer, is desired to be installed, a new hub assembly must be installed. Since the hub assembly in an automatic fluid dispensing system includes electronic sensing devices, replacement of the hub can be a difficult and expensive proposition, if possible at all.

Therefore, it is an object of the present invention to provide a universal hub for an automatic fluid dispensing device, which hub can be adapted to work with only one or with a plurality of dispensing heads or spouts for the delivery of the fluid to a user. The present invention, in one example, contemplates a hub assembly for a dispensing head that can form an attachment with a plurality of fluid dispensing spout devices, either fixed or rotating top, that are supplied by various manufacturers. In the alternative, the present invention can be adapted to provide a unique pattern of attachment elements between a fluid dispenser hub assembly and a specific fluid dispensing head assembly such that only the fluid dispensing head of a specific manufacturer can be installed on the hub assembly.

A further object of the present invention is to provide universal hub embodiments that are suitable for attachment to a variety of partially rotatable and non-rotatable fluid dispensing heads.

These and other inventive features of the present invention will become apparent upon reading the following detailed description in conjunction with the attached drawing. In the drawing figures, which are merely illustrative and are not intended to limit the scope of the invention defined in the attached claims:

DESCRIPTION OF THE ILLUSTRATED EMBODIMENTS

Figure 1:
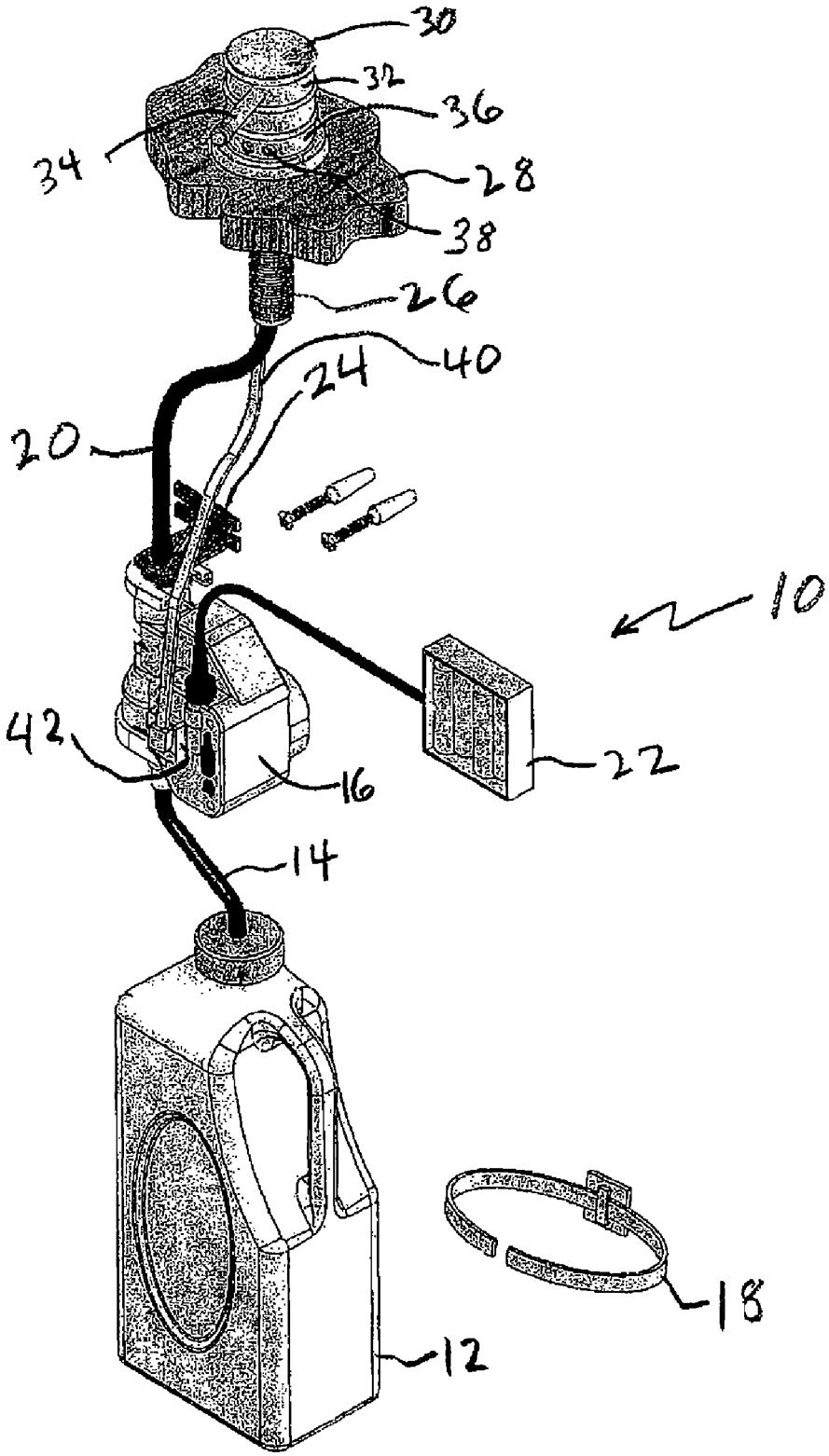
FIG. 1 is a perspective schematic view of one type of fluid dispensing system embodying the novel hub assembly of the present invention.

Referring to FIG. 1, a typical automatic fluid dispensing system is designated by the numeral 10, and comprises a fluid reservoir 12 connected by a conduit 14 to a pump assembly and housing 16. The reservoir 12 is adapted to be mounted on a wall or other suitable structure by mounting bracket and strap assembly 18. Typically, pump assembly 16 comprises a self-priming pump that transports fluid from reservoir 12 to inlet conduit 20 upon actuation of the pump assembly. A battery pack 22 supplies power to operate the self-priming pump assembly 16. A bracket 24 mounts pump assembly 16 to the wall or other suitable structure.

Inlet conduit 20 extends through the hollow interior of externally threaded hollow shank 26. Shank 26 is firmly secured, such as by an internally threaded nut or mounting disc (not shown) to countertop 28, such as typically found in a residential, commercial or industrial kitchen or washroom, as will be described. It is also to be understood that fluid dispensing system 10 can be utilized to dispense any type of liquid or fluid, such as soap, detergent, lotion, sanitizers, and the like.

A fluid dispensing head and sensor hub assembly 30 is mounted to hollow shank 26, the hub assembly 30 including a rotatable or non-rotatable top 32 having a hollow fluid dispensing spout 34 extending therefrom for delivery of fluid to a user. The hub assembly 30 also includes a fixed body 36 beneath the top 32, with a sensor lens 38 located in the fixed body below the spout 34. As will be described, an electronic sensor is located behind lens 38, which sensor is electrically connected by electrical cord 40 to an actuating mechanism 42 of pump assembly 16. The electrical cord 40 extends from the sensor behind lens 38 through the hollow portion of shank 26, and adjacent inlet conduit 20. When a user places their hands beneath spout 34, the sensor behind lens 38 senses the placement of the hands, and a signal is sent through cord 40 to actuating mechanism 42. Self-priming pump assembly 16 is then operated to transmit a pre-determined portion of liquid or fluid through inlet conduit 20, through spout 34, and into the hands of the user. As will be explained, the inlet conduit 20, in one embodiment, forms part of a fluid conveyance path and is connected to a hollow bolt assembly in fixed body 36 through which fluid is transmitted to spout 34.

Figure 2:
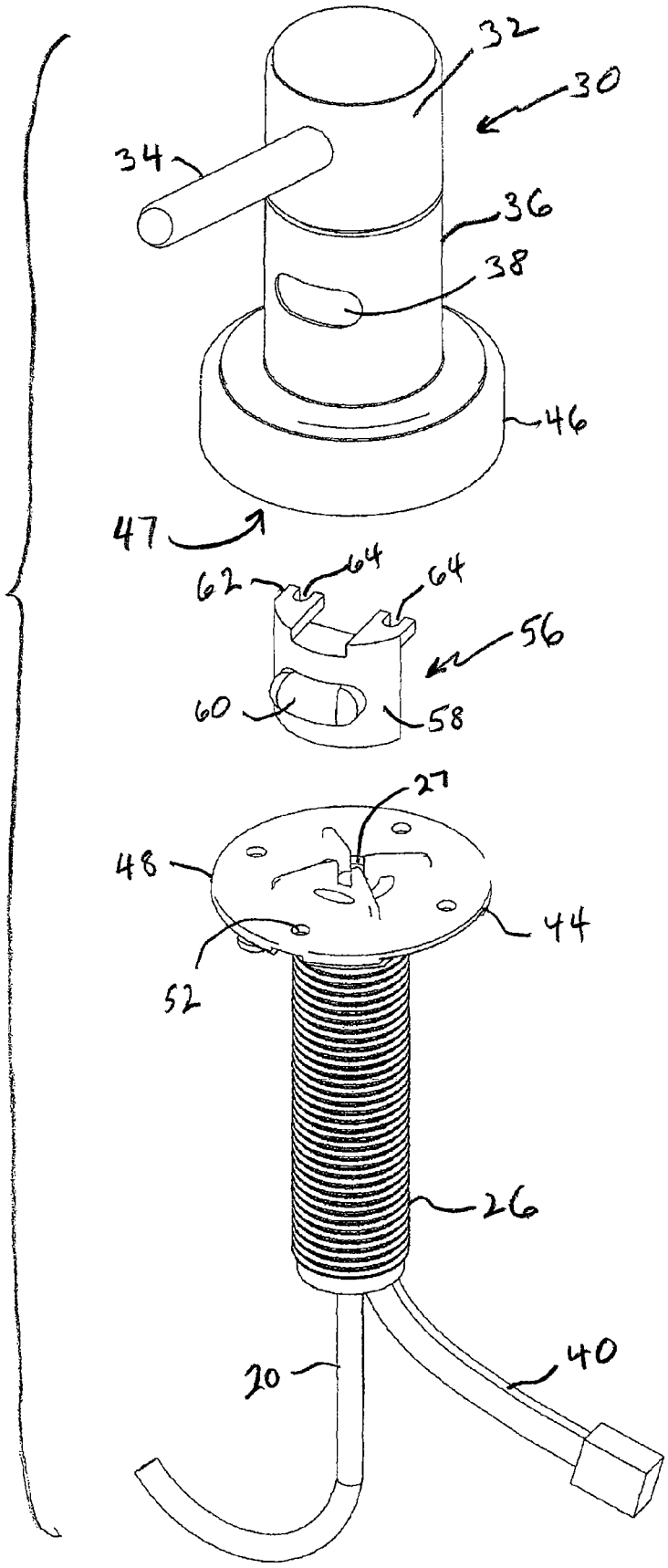
FIG. 2 is a partial exploded perspective view of the shank and sensor assembly, and a rotatable embodiment of the fixed body and fluid dispenser of an embodiment of the present invention.
Figure 3:
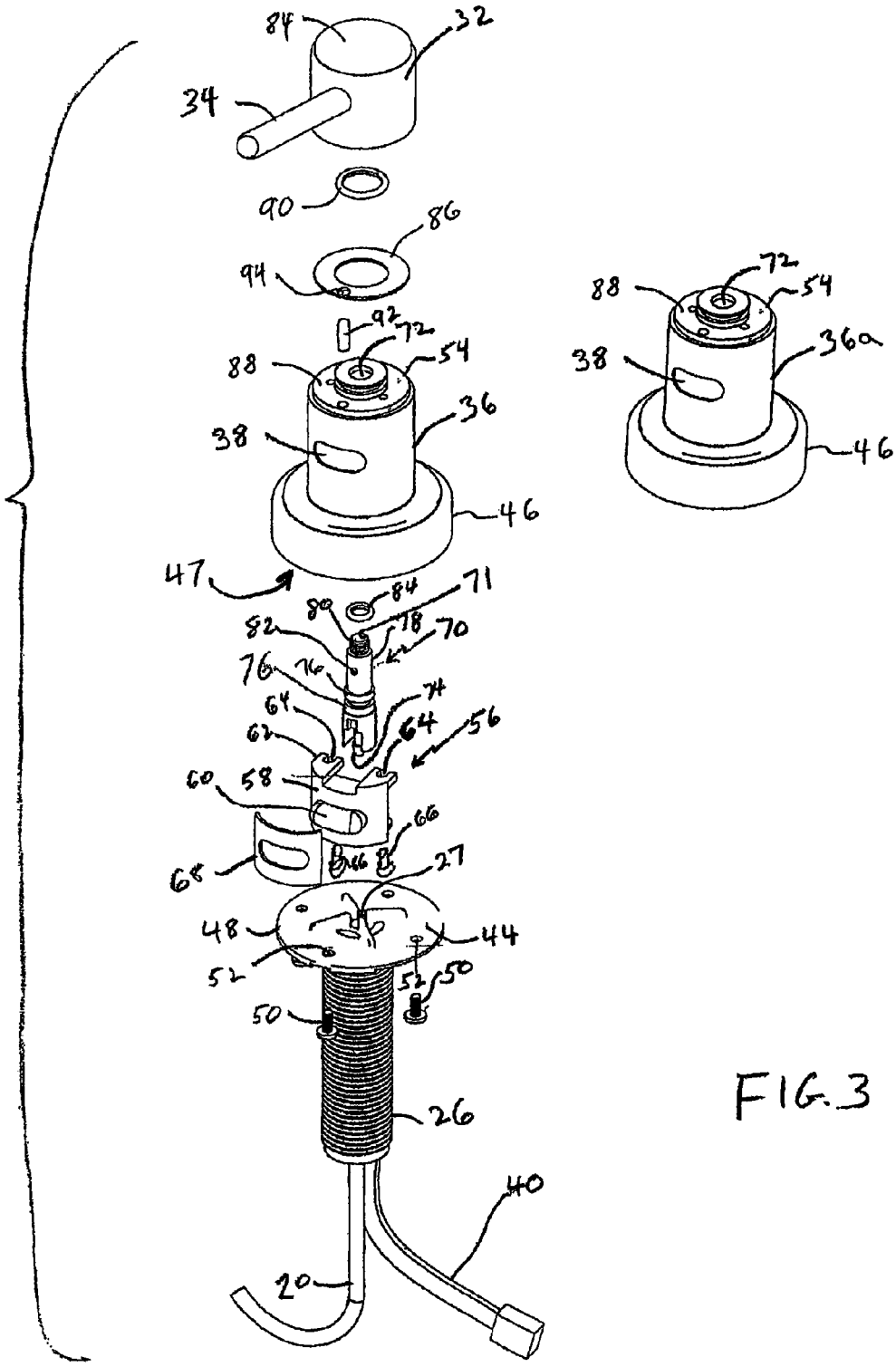
FIG. 3 is another exploded perspective view of the fluid dispenser of FIG. 2, illustrating additional details of the bolt assembly and fixed body of the present invention.

Referring to FIGS. 2 and 3, an embodiment of the fluid dispensing head and sensor assembly 30 and hollow shank 26 is disclosed. The hollow shank 26 extends along a central axis (not shown). A shank hub 44 is mounted to the upper portion of shank 20, and the shank hub 44 extends in a radial direction relative to the central axis of hollow shank 26. If desired, shank hub 26 and hub 44 can be molded from a single piece of material, such as plastic on metal. An aperture 27 extends through shank hub 26, which aperture is aligned with the hollow center of shank 26. When installed through an aperture in countertop 28 (FIG. 1), the underside of shank hub 44 engages upper surface of countertop 28, and a bolt (not shown) on shank 26 engages the underside of countertop 28 to hold shank 26 and hub 44 securely in place on the countertop.

Referring to FIG. 3, fixed body 36 includes a base portion 46 that is hollow and is adapted to fit over the outer circumference 48 of shank hub 44. A hollow chamber 47 is formed in the interior of fixed body 36 and base portion 46. Attachment fasteners such as screws 50 extend through apertures 52 in hub 44 to attach fixed body 36 to shank hub 44. Apertures 52 in hub 44 and corresponding apertures (not shown) in the bottom of base portion 46 are arrayed in a predetermined pattern to allow apertures 52 to be in alignment with the apertures in the bottom of base portion 46.

Fixed body 36 has a hollow interior 47 and an upper cap portion 54. The underside of cap portion 54 faces downward in the hollow interior chamber 47 of fixed body 36. Sensor assembly 56 includes a sensor housing 58 to which an electronic sensor 60 is mounted. Sensor assembly 56 includes mounting flanges 62 having slots or apertures 64, the slots or apertures 64 adapted to receive fasteners such as screws 66. Screws 66 extend through slots or apertures 64, and the screws are threaded into the underside of upper cap portion 54 to securely mount the sensor 60 in chamber 47 adjacent sensor lens 38 in the fixed body 36. A gasket 68 is provided between the sensor 60 and sensor lens 38.

A hollow bolt assembly 70 is rotatably mounted through aperture 72 in upper cap portion 54 of fixed body 36. An axially extending channel 71 (FIG. 3) extends through bolt 70 and forms part of the fluid conveyance path. An appropriate stop mechanism in the illustrated embodiment limits rotative movement of bolt assembly 70 to about one hundred twenty degrees around a vertical axis. A nipple 74 is located at the bottom of bolt assembly 70, whereby nipple 74 is adapted to be connected to inlet tube 20 to convey fluid along the fluid conveyance path into the hollow interior of bolt assembly 70. A pair of flanges 76 engage a corresponding flange (not shown) on upper cap portion 54 of fixed body 36 to rotatably mount bolt assembly 70 to fixed body 36.

Bolt assembly 70 also includes an upper hollow shaft portion 78 having an externally threaded portion 80 and at least one aperture 82 communicating between the hollow interior portion of bolt assembly 70 and the exterior outer surface of shaft portion 78. An O-ring seal 84 extends around threaded portion 80.

Upper shaft portion 78 of bolt assembly 70 extends outward from aperture 72 in cap portion 54. Top 32 has a substantially hollow, U-shaped interior with an internally threaded coupling (not shown) extending downward from the inside surface of upper plate 84. The internally threaded coupling is adapted to connect with externally threaded cap portion 80 of bolt 70, thus securing top 32 to bolt 70. In an embodiment, as bolt 70 rotates through its limited arc, top 32 and spout 34 likewise rotate through the same limited arc.

A bearing washer 86 is located between surface 88 of upper cap portion 54 and top 32 to provide a rotating interface between rotating top 32 and fixed body 36. An O-ring seal 90 is interposed between the interior of top 32 and upper portion 78 of bolt 70 to prevent liquid dispensed through aperture 82 from migrating into fixed body 36. Additionally, a pin 92 extends through aperture 94 in bearing washer 86. Pin 92 is adapted to contact a pair of stop surfaces (not shown) to limit the rotation of top 32 and bolt 70 through a pre-determined arc, which is one hundred twenty degrees in the illustrated embodiment. It is also understood that in a further embodiment, the top 32 and spout 34 in the illustrated embodiment can be fixed against rotation relative to fixed body 36.

In operation, referring to the embodiment disclosed in FIGS. 1, 2 and 3, a user inserts his/her hands beneath the spout 34, and the sensor 60 detects the presence of the hands. A signal is sent through electrical cord 40 to actuator 42, and self-priming pump assembly 16 delivers a pre-determined amount of fluid to inlet conduit 20. The fluid is advanced through nipple 74 and into the hollow portion of bolt 70 (FIG. 3) and the hollow interior portion of top 32. The fluid then advances along spout 34 into the hands of the user.

A feature of the present invention is to provide for the replacement of rotating or stationary top 32 on fixed body 36 and bolt assembly 70. To remove top 32 from bolt assembly 70, a pronged tool is applied to the bottom of bolt 70 (FIG. 3) and bolt assembly 70 is rotated counterclockwise to disengage top 32 from externally threaded cap portion 80 of the bolt assembly. A new top 32 with spout 34 is then placed over threaded cap portion 80 and fastened onto bolt assembly 70.

Additionally, a feature of the present embodiment of the invention shown in FIGS. 2 and 3 is to provide replacement of fixed body 36 and top 32 with a dispensing head of a different style, or from a different manufacturer. After top 32 has been detached from bolt 70, shank hub 44 and hollow shank 26 are removed from countertop 28. Then, screws 50 are removed from apertures 52 and from the corresponding apertures (not shown) in the bottom of base portion 46 of fixed body 36. Also, the electrical connection between sensor assembly 56 and cord 40 is detached. Fixed body 36, with sensor assembly 56 attached, is lifted off of bolt 70.

A second fixed body **36*a* forming part of a fluid dispenser head is then attached to shank hub 44 after cord 40 has been attached to a sensor assembly 56 in the second fixed body 36*a*. The apertures in the bottom portion of the second fixed body 36*a* are arrayed in the same predetermined pattern as the apertures 52 in shank hub 44. The top of second fixed body 36*a* is attached to the mounting portion of cap portion 80 on bolt 70. Screws 50 are next inserted into and rotated in apertures 52 to secure the base portion 46 of the second fixed body 36*a* to shank hub 44. Shank 26 is then inserted back into the aperture (not shown) in countertop 28, and the nut holding shank 26 to the countertop is re-installed via the threads on shank 26. The apparatus with the second fixed body 36*a*** is then ready for normal operation.

Figure 4:
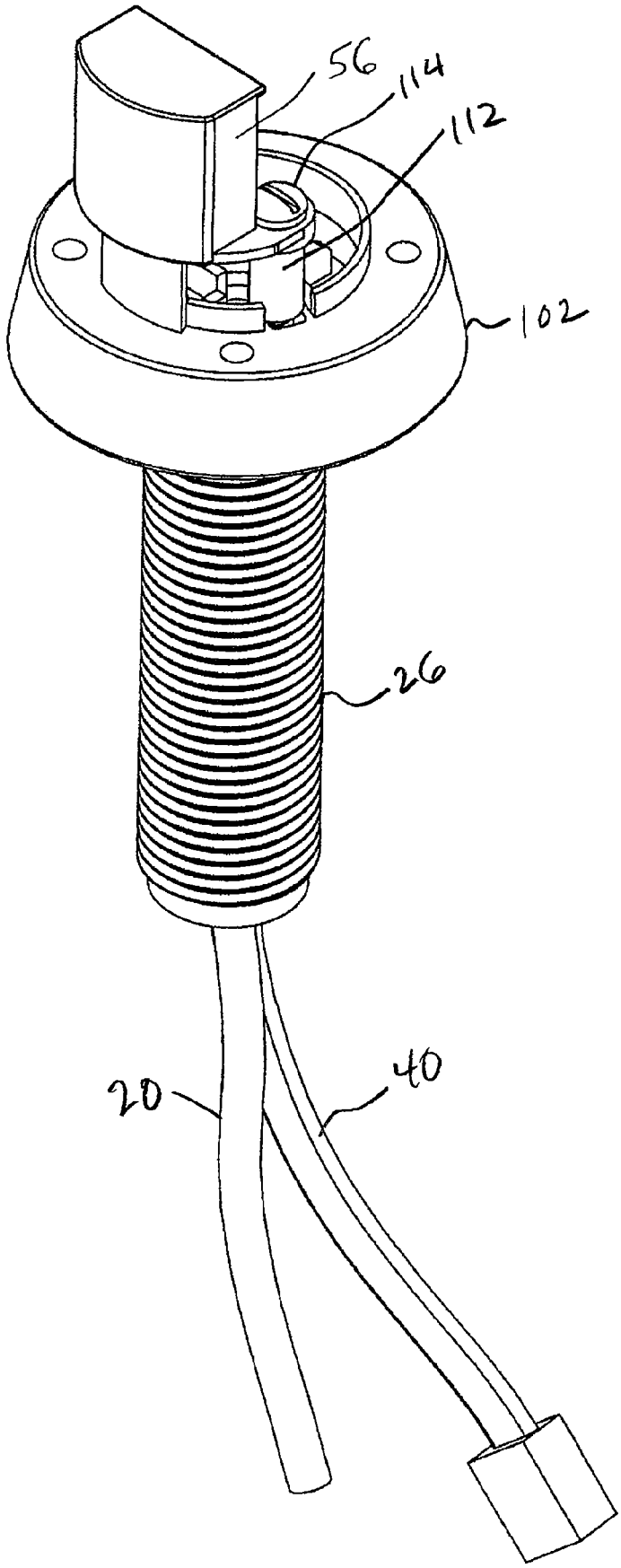
FIG. 4 is a detail perspective view of the shank, hub spacer and sensor assembly of a further embodiment of the present invention.
Figure 5:
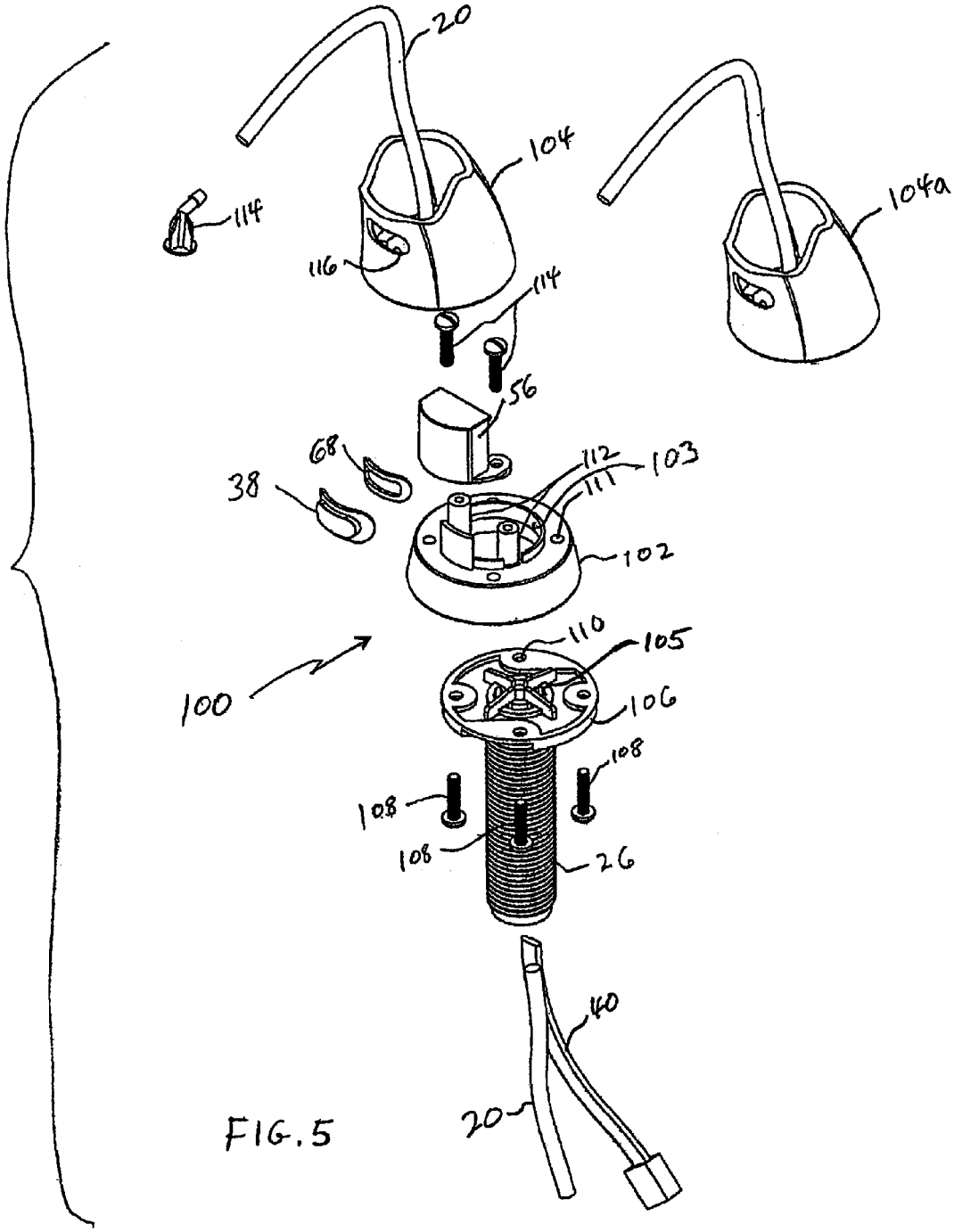
FIG. 5 is an exploded perspective view of the further embodiment of the present invention shown in FIG. 4, particularly illustrating the structure for mounting the sensor assembly on the hub spacer.

Referring to FIGS. 4 and 5, a second embodiment of the present fluid dispenser invention is disclosed and is generally designated by the numeral 100. In this embodiment, the sensor assembly 56 is attached to and forms part of the shank 26, and is not fixed to the interior of fixed body 104. Shank hub 106 is attached to or formed as a part of shank 26. As seen in FIGS. 4 and 5, a hub spacer 102 is attached to shank hub 106 by means of screws 108, or other suitable fasteners that extend through apertures 110. Screws 108 also attach fixed body 104 to hub spacer 102 and shank hub 106.

Hub spacer 102 comprises a pair of internally threaded tubes 112 to which sensor assembly 56 is mounted to hub spacer 102 by means of screws 114. A gasket 68 (FIG. 5) is disposed between sensor assembly 56 and outer sensor lens 38. Thus, sensor assembly 56 is attached to shank 26 and shank hub 106, which remains when fixed body 104 is replaced by a second fixed body. Hub spacer 102 has a central aperture 103 that is adapted to align with aperture 105 in shank hub 106.

Fixed body 104, as previously stated, is attached to hub spacer 102 by means of screws 108. A hollow spout (not shown) extends outward in a substantially radial direction from fixed body 104. Inlet conduit 20 extends through the hollow center of shank 26, through hub spacer 102 and fixed body 104 to a spout aperture assembly designated 114. Liquid, in this embodiment, is conveyed through a path defined by inlet conduit 20 direct to the hands of the user. Also, in this embodiment as in the first embodiment, an electrical cord 40 transmits a signal from sensor assembly 56 to actuating mechanism 42 (FIG. 1) as previously described.

Additionally, fixed body 104 includes an aperture 116 through which outer sensor lens 38 protrudes in a non-rotatable embodiment of the structure of FIGS. 4 and 5. In an alternate embodiment where fixed body 104 includes a swivel top assembly (not shown), outer lens 38 is flush to the fixed body 104 to permit unimpeded rotation of the spout and fixed body 104 relative to sensor assembly 56.

As seen in FIG. 5, apertures 110 in shank hub 106 are arrayed in a predetermined pattern on the shank hub. Apertures 111 in hub spacer 102 are also arrayed in the same predetermined pattern as apertures 110, so that apertures 110 and 111 are in alignment when hub spacer 102 is placed over shank hub 106. Also, the bottom of fixed body 104 includes a plurality of apertures (not shown), which apertures are also arrayed in the same predetermined pattern as apertures 110 and 111. Thus, when hub spacer 102 is placed over shank hub 106, and fixed body 104 is placed over hub spacer 102, apertures 110 and 111 align with the apertures in the bottom of fixed body 104. Attachment screws 108 are then rotated through the aligned apertures until fixed body 104, hub spacer 102 and shank hub 106 are attached to each other.

In the embodiment of FIGS. 4, 5, the fixed body 104 may be readily replaced by removing screws 108 and detaching fixed body 104 from hub spacer 102. To replace the fixed body, flexible conduit 20 is detached from spout aperture assembly 114 and is withdrawn from the spout (not shown) forming part of or attached to fixed body 104. Screws 108 are removed from shank hub 106 and hub spacer 102, and fixed body 104 is lifted upward and removed. Sensor assembly 56 remains attached to hub spacer 102. A second fixed body 104*a*, of either the rotatable or non-rotatable type, is placed over sensor assembly 56. The second fixed body 104*a* has internally threaded apertures at the bottom of the fixed body, which apertures are arrayed in the same predetermined pattern as apertures 111 and 110, and therefore align with corresponding apertures 110 in shank hub 106 and apertures 111 in hub spacer 102. After the second fixed body 104*a* is mounted on hub spacer 102, screws 108 are installed to tightly mount shank hub 106, hub spacer 102 and second fixed body 104*a* to each other. Inlet fluid conduit 20 is then fed through shank 26, hub spacer 102 and into the second fixed body 104*a* until the conduit 20 extends outward a short distance from the spout attached to second fixed body 104*a*. The outer end of conduit 20 is then re-attached to spout aperture assembly 114.

In the embodiment of FIGS. 4 and 5, the sensor assembly 56 remains fastened to hub spacer 102 as the first fixed body 104 is removed from hub spacer 102 and replaced with a second fixed body 104*a*.

The foregoing description of a preferred embodiment of the invention has been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and various modifications as are suited to the particular use contemplated. It is intended that the scope of the invention not be limited by the specification, but be defined by the claims set forth below.

We claim:

1. A removable and replaceable dispensing head for a fluid dispensing system adapted to deliver the fluid to a user, comprising:

a. a shank having a hollow portion extending on an axis;

b. a shank hub having a first side permanently attached to said shank and a second side, said shank hub extending in a radial direction relative to said axis at one end of said shank and a sensor assembly attached to said second side;

c. said shank hub including an aperture extending therethrough, said aperture aligned with the hollow portion of said shank;

d. a first fixed body removably attached to said shank hub, said first fixed body and said shank hub having corresponding first attachment means arrayed in a predetermined pattern;

e. said shank, said aperture in said shank hub and said first fixed body providing a fluid conveyance path;

f. a second fixed body having second attachment means arrayed in said predetermined pattern, said second attachment means corresponding to said first attachment means in said shank hub enabling removable attachment of said second fixed body to said shank hub upon removal of said first fixed body from said shank hub.

2. The dispensing head of claim 1, wherein said sensor assembly is disposed in a chamber formed in said first fixed body.

3. The dispensing head of claim 2, wherein said first fixed body has an upper cap portion partially defining said chamber.

4. The dispensing head of claim 1 wherein said first fixed body includes a rotatable top portion and a fixed lower portion, said top portion pivotal about an axis through a predetermined arc relative to the fixed lower portion.

5. The dispensing head of claim 4, wherein the rotatable top portion includes a hollow spout communicating with said fluid conveyance path.

6. The dispensing head of claim 5 wherein said dispensing head is adapted to dispense fluid from said fluid conveyance path through said spout upon the detection of the presence of a user by the sensor assembly.

7. The dispensing head of claim 4 including a fluid seal between the rotatable top portion and the fixed lower portion.

8. The dispensing head of claim 3 wherein said upper cap portion of said first fixed body includes an aperture extending through said upper cap portion;

a bolt rotatably mounted in said aperture, said bolt having a hollow axial channel forming part of said fluid conveyance path;

a mounting portion formed on an upper extent of said bolt, said fluid conveyance path extending through said mounting portion;

a top removably attached to the mounting portion of said bolt.

9. The dispensing head of claim 8 wherein said top defines a chamber;

a hollow spout attached to said top, said hollow spout communicating with said chamber in said top, said hollow spout and said chamber forming part of said fluid conveyance path.

10. The dispensing head of claim 8 wherein said bolt includes a hollow nipple communicating with said hollow axial channel, said hollow nipple adapted to be connected to a source of said fluid.

11. A dispensing head for a fluid dispensing system, comprising:

a. a first fixed body having a hollow central portion, said hollow central portion having an upper cap portion;

b. said first fixed body removably attached to a hub, said hub mounted on a shank having a hollow portion, said hub having a central aperture aligned with the hollow portion of the shank;

c. a lens mounted in an aperture extending through said first fixed body;

d. a sensor assembly including a sensor mounted in said first fixed body and adjacent said lens, said sensor adapted to detect the presence or absence of a user of the fluid dispensing system;

e. a bolt having a hollow central channel, said bolt extending through an aperture in said upper cap portion, said bolt mounted in said aperture of said upper cap portion for limited rotative movement of said bolt relative to said upper cap portion;

f. a top removably attached on an upper portion of said bolt, said top having a hollow chamber formed therein, said hollow chamber communicating with the hollow central channel in said bolt;

g. a hollow fluid delivery spout mounted to said top, said hollow spout in communication with said hollow central portion of said first fixed body;

h. said first fixed body and said sensor assembly adapted to be removed from said hub, and said top adapted to be detached from said bolt;

i. said bolt adapted to be attached to a second fixed body.

12. The dispensing head of claim 11, said first fixed body having a plurality of apertures arrayed in a predetermined pattern on a bottom portion of said first fixed body;

said hub having a plurality of apertures extending therethrough, said apertures in said hub arrayed in said predetermined pattern;

removable attachment means removably attaching said first fixed body to said hub, said attachment means adapted to extend through said aligned apertures in said first fixed body and said hub;

said second fixed body having a plurality of apertures arrayed in a predetermined pattern on a bottom portion of said second fixed body, said attachment means adapted to removably attach said second fixed body to said hub after said first fixed body has been removed from said hub.

13. The dispensing head of claim 12 wherein said attachment means extend through said aligned apertures in said second fixed body and said hub to removably attach said second fixed body to said hub.

14. A removable and replaceable dispensing head for a fluid dispensing system adapted to deliver the fluid to a user, comprising:

a. a shank having a hollow portion extending on an axis;

b. a shank hub attached to said hollow shank, said shank hub extending in a radial direction relative to said axis at one end of said hollow shank;

c. said shank hub including an aperture extending therethrough, said aperture aligned with the hollow portion of said shank;

d. a fixed body removably attached to said shank hub, said fixed body and said shank hub having corresponding first attachment means arrayed in a predetermined pattern;

e. said hollow shank, said aperture in said shank hub and said fixed body providing a fluid conveyance path;

f. a sensor assembly disposed in a chamber formed in said fixed body, said sensor assembly attached to one of said chamber in said fixed body and said shank hub, wherein said fixed body has an upper cap portion partially defining said chamber, said sensor assembly attached to said upper cap portion wherein said upper cap portion of said fixed body includes an aperture extending through said upper cap portion;

a bolt rotatably mounted in said aperture, said bolt having a hollow axial channel forming part of said fluid conveyance path;

a mounting portion formed on an upper extent of said bolt, said fluid conveyance path extending through said mounting portion;

a top removably attached to the mounting portion of said bolt.

* * * * *